US008627699B2

(12) United States Patent
Eckelsbach et al.

(10) Patent No.: US 8,627,699 B2
(45) Date of Patent: Jan. 14, 2014

(54) DEVICE AND METHOD FOR ADJUSTING AN EDGER

(75) Inventors: Kurt Eckelsbach, Hilchenbach (DE); Mario Perboni, Mariano Comense (IT); Antonino Rossi, Gorgonzola (IT)

(73) Assignee: SMS INNSE SpA, S. Donato Milanese (IT)

( * ) Notice: Subject to any disclaimer, the term of this patent is extended or adjusted under 35 U.S.C. 154(b) by 590 days.

(21) Appl. No.: 12/937,530

(22) PCT Filed: Apr. 23, 2008

(86) PCT No.: PCT/IT2008/000288

§ 371 (c)(1),
(2), (4) Date: Oct. 12, 2010

(87) PCT Pub. No.: WO2009/130726

PCT Pub. Date: Oct. 29, 2009

(65) Prior Publication Data

US 2011/0030437 A1 Feb. 10, 2011

(51) Int. Cl.

| | |
|---|---|
| ***B21B 39/20*** | (2006.01) |
| *B21B 13/08* | (2006.01) |
| *B21B 29/00* | (2006.01) |

(52) U.S. Cl.
USPC ..... 72/252.5; 72/234; 72/241.6

(58) Field of Classification Search
USPC ..... 72/366.2, 199–252.5
See application file for complete search history.

(56) References Cited

U.S. PATENT DOCUMENTS

| | | | | |
|---|---|---|---|---|
| 3,610,100 | A * | 10/1971 | Hoffman | 91/167 R |
| 6,116,140 | A * | 9/2000 | Barthalow et al. | 91/167 R |
| 2007/0062240 | A1 * | 3/2007 | Lindner et al. | 72/245 |

FOREIGN PATENT DOCUMENTS

| | | | |
|---|---|---|---|
| EP | 0 551 716 | A1 | 7/1993 |
| EP | 0 947 709 | A1 | 10/1999 |
| JP | 60 129407 | A | 7/1985 |
| WO | WO-2005/049242 | A1 | 6/2005 |

OTHER PUBLICATIONS

JP-60129407; Fluid pressure cylinder and vertical mill equipped with such fluid pressure cylinders; Toshiro Masushita, et al. tanslation by U.S. Patent and Trademark office, Washington D.C. May 2013; PTO 13-3812; date:Jul. 10, 1985.*

* cited by examiner

*Primary Examiner* — Dana Ross
*Assistant Examiner* — Lawrence Averick
(74) *Attorney, Agent, or Firm* — Perkins Coie LLP

(57) ABSTRACT

A device for adjusting the distance between a pair of work rollers (40) in an edger of a rolling mill comprising actuator means associable with a respective work roller (40). The actuator means comprise a roll group (10; 10*s*) including two cylinders (20, 20*s*; 30, 30*s*) associated with each other so to slide inside each other and movable between a withdrawn or maximum distance position between the rollers (40) and an advanced or minimum distance position between the rollers (40).

23 Claims, 9 Drawing Sheets

Fig. 1A
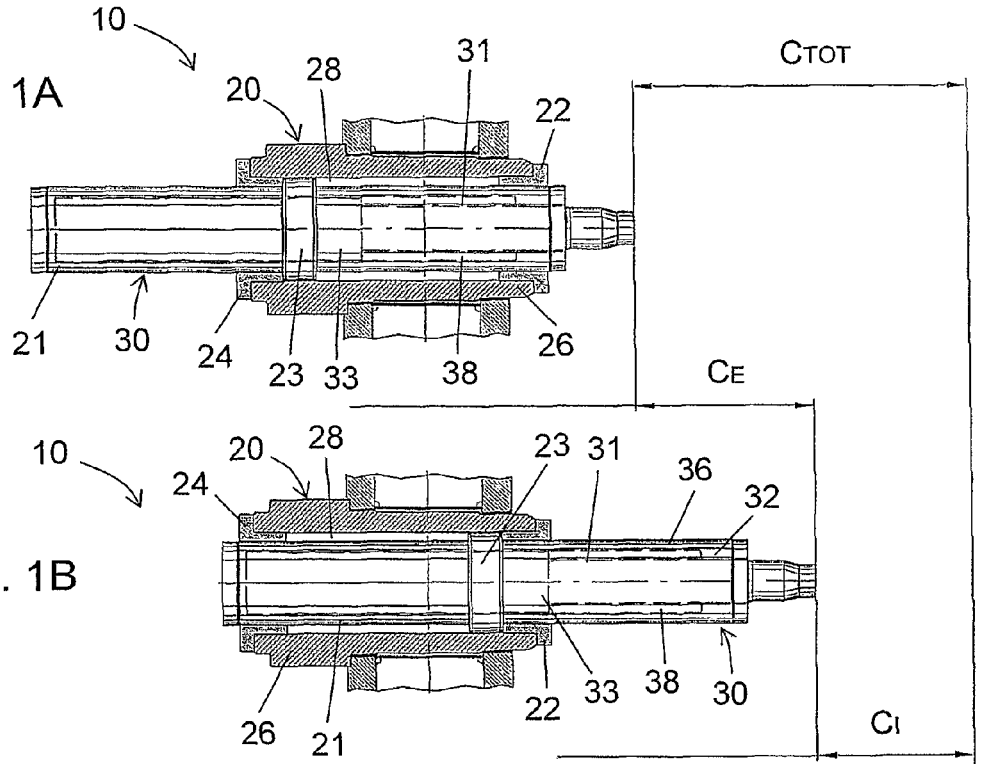
Fig. 1B
Fig. 1C
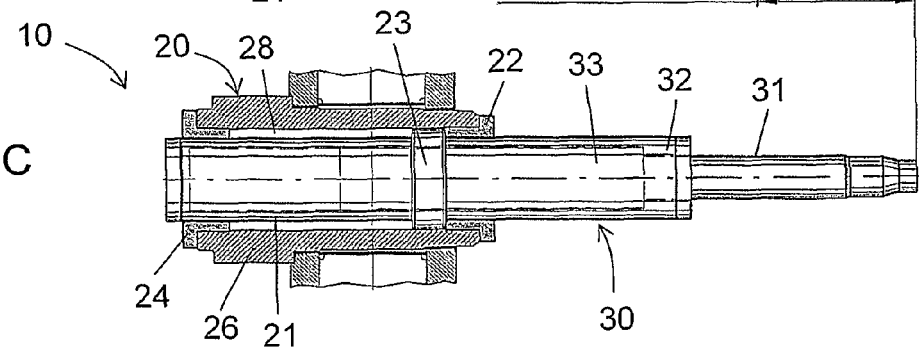

(1) Controlled roll = active – ON/OFF roll = OFF
(2) Controlled roll = non-active – ON/OFF roll = ON
(3) Controlled roll = active – ON/OFF roll = ON
(4) Controlled roll = active – ON/OFF roll = ON

DEVICE AND METHOD FOR ADJUSTING AN EDGER

CROSS-REFERENCE TO RELATED APPLICATIONS

This application is a 35 USC §371 application of International Application No. PCT/IT2008/000288 filed Apr. 23, 2008, which is hereby incorporated by reference in its entirety.

TECHNICAL FIELD OF THE INVENTION

The present invention regards, in general, the field of rolling plants for ferrous and non-ferrous material, in particular strips and sheets, and more specifically, a device and a method of adjusting the distance between a pair of rollers of an edging stand, below identified as edger, associable with a rolling plant.

BACKGROUND OF THE INVENTION

As is known, a rolling mill, particularly for the rolling of strips and sheets, is composed of one or more rolling stands arranged in series to form a rolling train. Inside each rolling stand, a pair of work rolls is housed and moved through adapters by electric motors.

A slab, heated to the rolling temperature in the heating furnaces, after a period of descaling, is made to pass between the work rolls of the rolling mill until it reaches the desired dimensions. The set of subsequent passages through the ports between the rolls forms the rolling path.

Two rolling process series are distinguished: a roughing process, which starts from the fusion product and leads to an intermediate product, called preform, and a finishing process, which leads from the preform to the finished product. In the roughing process, the rolling is carried out at hot temperatures, while the finishing process can be conducted hot, cold or partly hot and partly cold.

During the hot rolling of strips and sheets, the preform can have shape defects, which the cold finishing is unable to completely correct. These are mainly defects deriving from non-uniform deformation of the material and the establishment of voltage fields inside the material during the rolling, with consequent formation of laps on the rolled material edges.

In order to minimize the formation of laps on the edges, and to maintain the width of the strip or sheet constant, one employs so-called width adjustment devices (AWC), commonly known as edging stands or edgers.

An edger is composed of a pair of vertical work rollers, each controlled, by means of a respective adapter, by an electric motor and by an adjustment system of the distance between the work rollers. In use, the work rollers are in contact with the lateral edges of the slab to be subjected to rolling.

It is desirable that the material exiting from the roughing train, specifically a bar or a plate, has precise width dimensions, whereby the distance between the work rollers of the edger must be able to be adjusted so to permit a control of the width of the material, in order to correct possible non-uniformities at the edges.

Over the years, different systems have been developed for the adjustment of an edger. A first example consists of a system of electromechanical type comprising a screw and a nut screw, a helical wheel and a worm screw. Such kinematic chain has the disadvantage of not permitting adjustments under load, involving long reaction times and thus being not very precise.

A faster and more precise adjustment system than the electromechanical system is represented by a electromechanical-hydraulic hybrid system, obtained by installing a hydraulic capsule, constituted by a cylinder and a small-stroke plunger, between auger and work roller. A system of this type, even if it permits quick corrections of the material width, is disadvantageous since it considerably complicates the structure of the edging stand and causes an increase in installation and maintenance costs.

The auger-capsule hydraulic system can finally be substituted with a single cylinder having a stroke ranging from 800-1000 mm. A solution of this type, even if it is well applied to edging stands coupled with rolling trains for strips, or rather with cylinders having a stroke equal to about 900 mm, is practically unusable in edging stands coupled with sheet trains, in which a cylinder stroke is necessary ranging from 1800-2500 mm.

It is known, in fact, that due to the compressibility of the hydraulic fluid therein contained, typically oil, the stiffness of the hydraulic cylinders decreases with the increase of the stroke, leading to considerable yields under load, with consequent reduction of the control accuracy of the width of the rolled material and the dynamic performances. It follows that, in the specific case of edgers coupled with sheet trains, the mechanical and electromechanical-hydraulic hybrid solutions are, up to now, the only ones applicable.

The main object of the present invention is that of resolving the technical problem outlined above by providing a completely hydraulic actuation device for adjusting the distance between the work rollers of one edging stand or edger, capable of quickly and precisely completing high adjustment strokes, i.e. ranging from 1800-2500 mm, so it can be used in edgers coupled with sheet trains.

Another object of the present invention is that of providing an edger equipped with an adjustment device with completely hydraulic actuation for adjusting the distance between the work rollers.

Not least object of the present invention is that of providing a method for adjusting the distance between a pair of work rollers in an edger of a rolling mill.

These and other objects, which will be clearer below, are attained by an adjustment device according to various embodiments of the present invention, by an edging stand or edger according to various embodiments of the present invention, and by an adjustment method according to various embodiments of the present invention.

Further advantageously aspects of the invention will be set forth in the dependent claims.

DETAILED DESCRIPTION OF THE DRAWINGS

Characteristics and advantages of the present invention will be clearer from the following detailed description of its currently preferred embodiments, provided as exemplifying and non-limiting with reference to the drawing set, wherein:

FIGS. 1A-1C are side views, in section and with parts removed, of a cylinder group of an adjustment device according to the invention in different operating positions;

Figure 2:
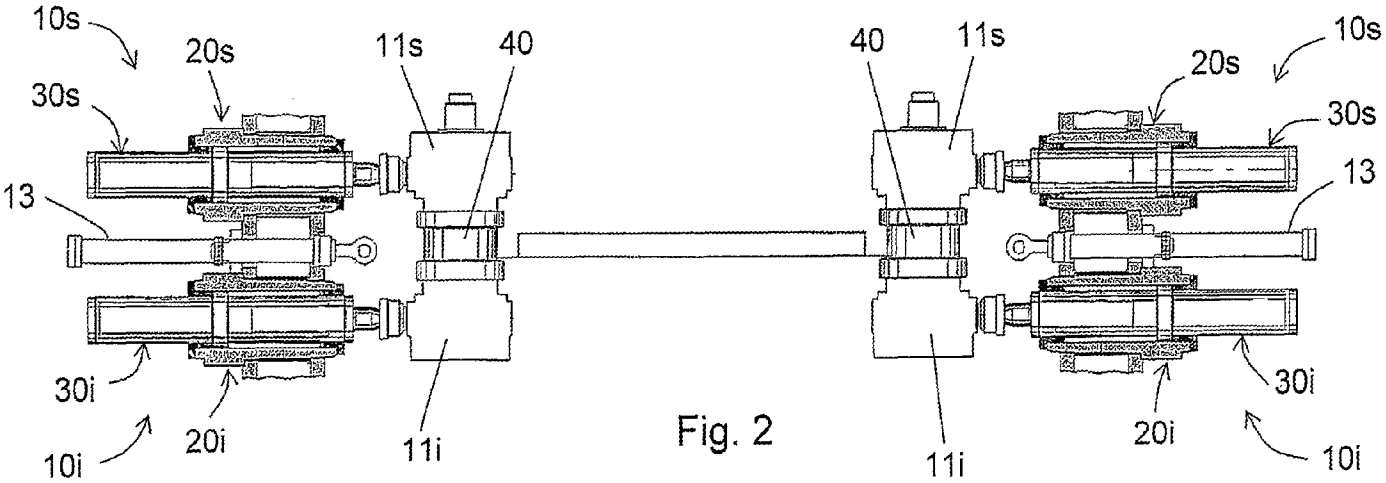
FIG. 2 is a side and section view of an adjustment device according to the invention with the rollers of the edger in maximum mutual distance position.
Figure 3:
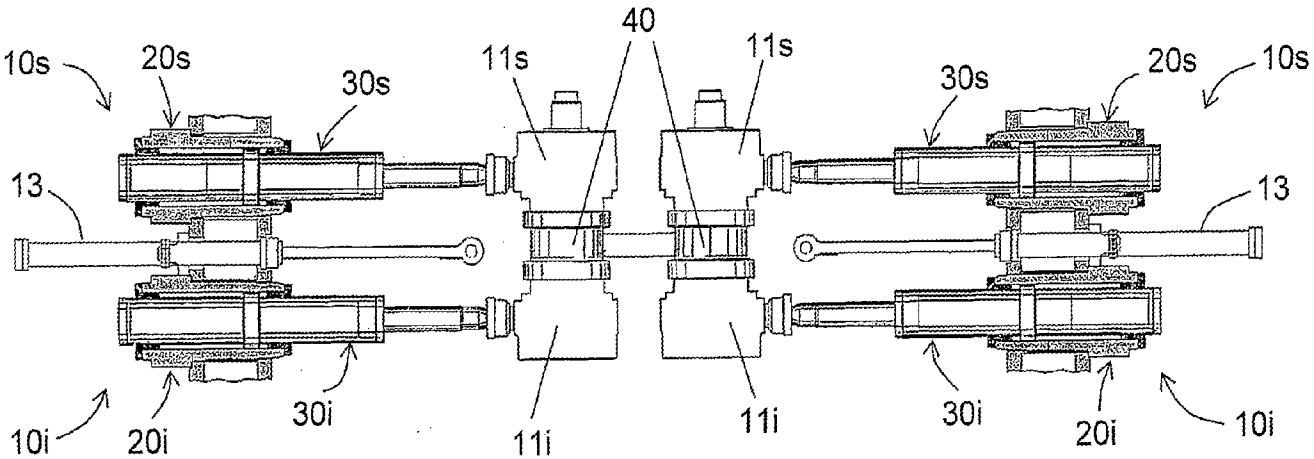
FIG. 3 is a section view of an adjustment device according to the present invention with the rollers in minimum mutual distance position.
Figure 4A:
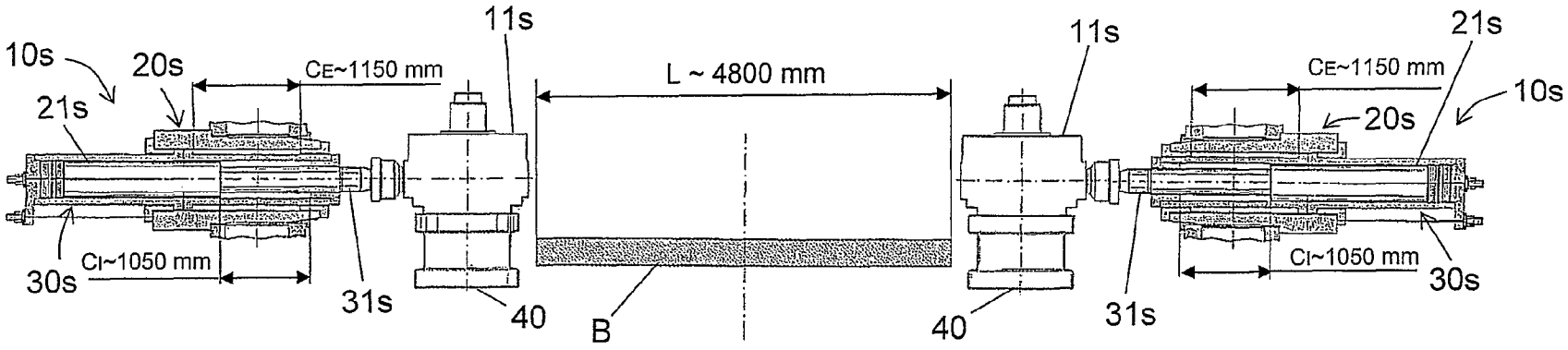
Figure 4B:
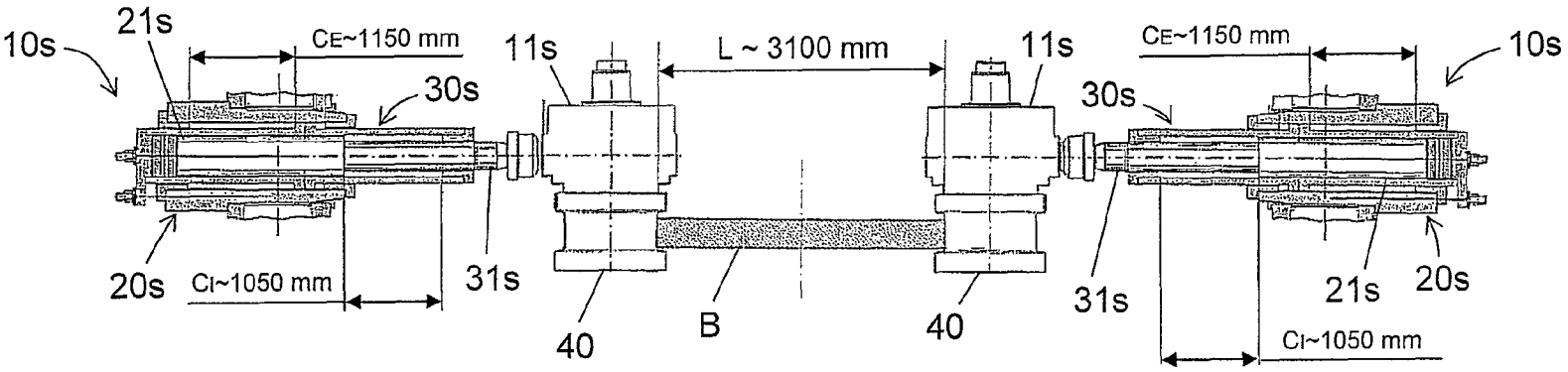
Figure 5A:
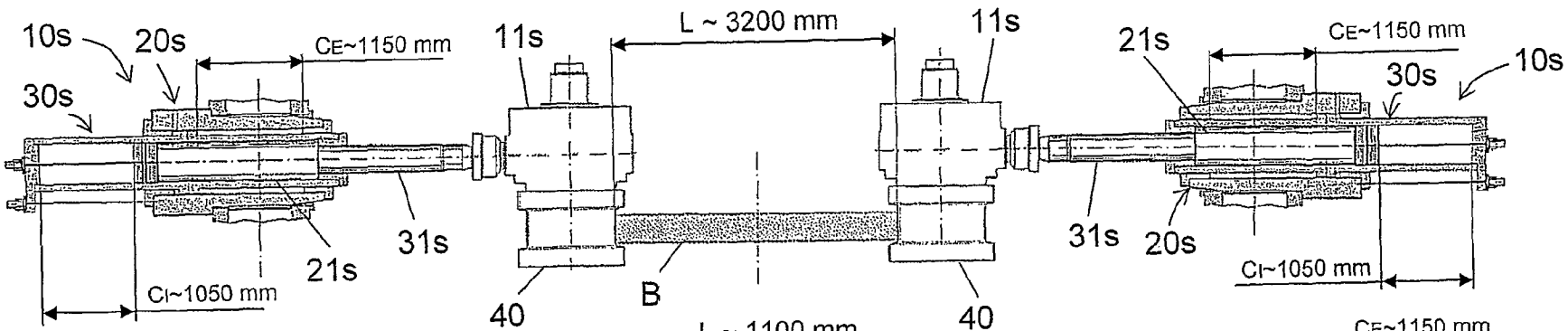
Figure 5B:
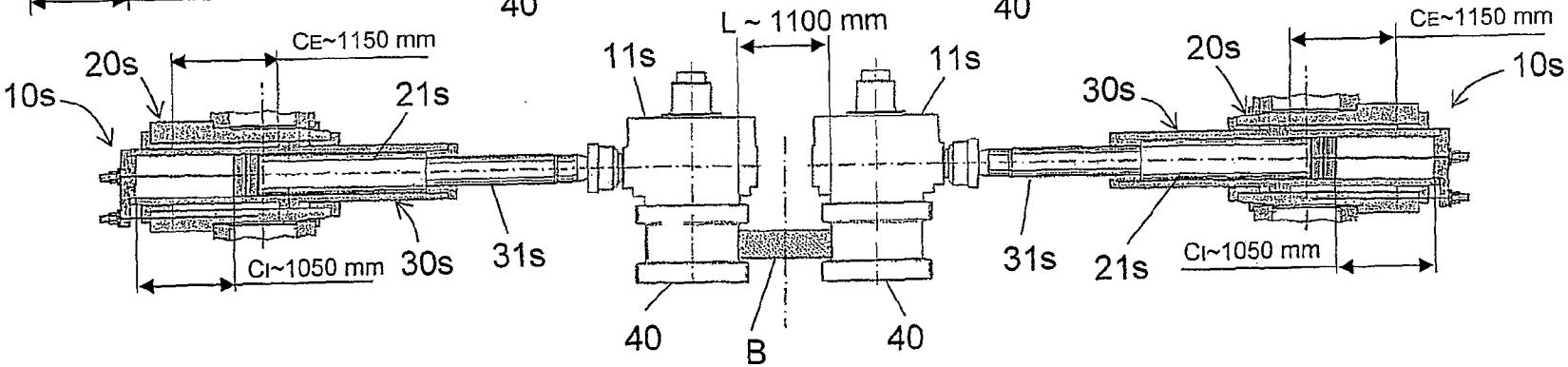
Figure 6:
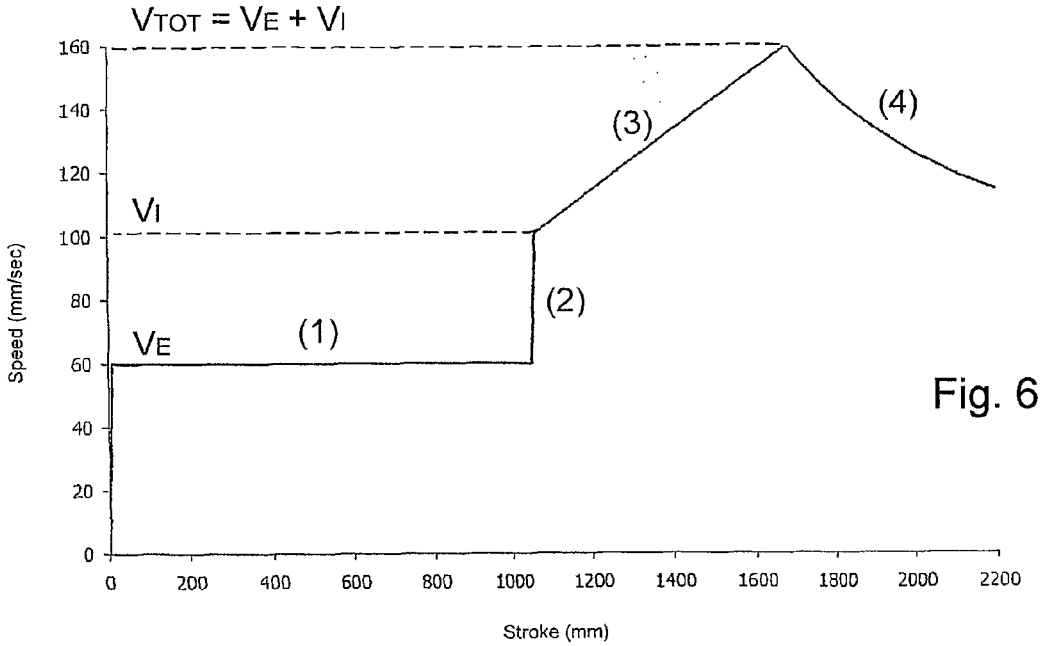
Figure 7:
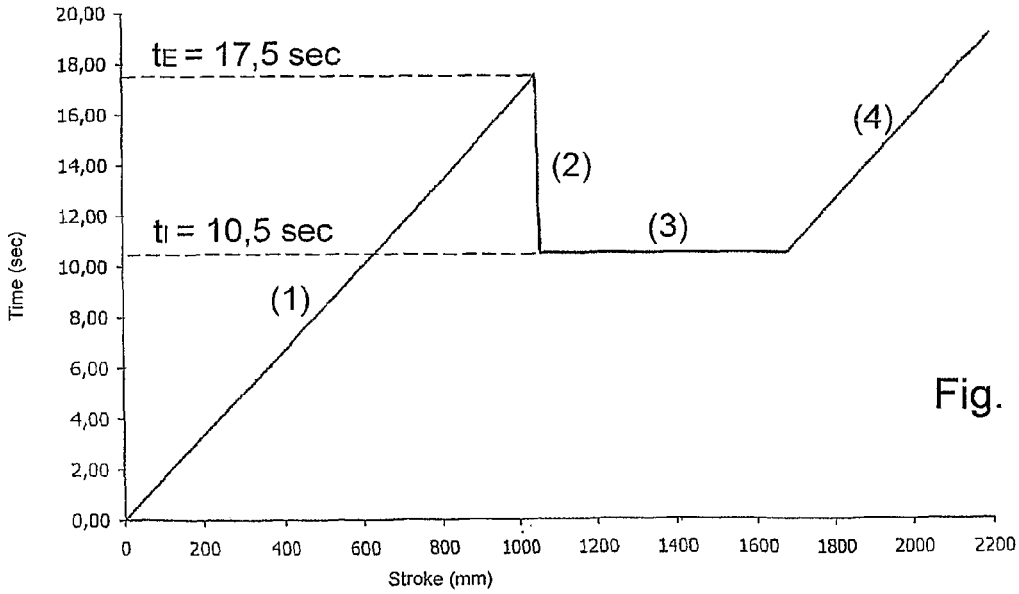
Figure 8:
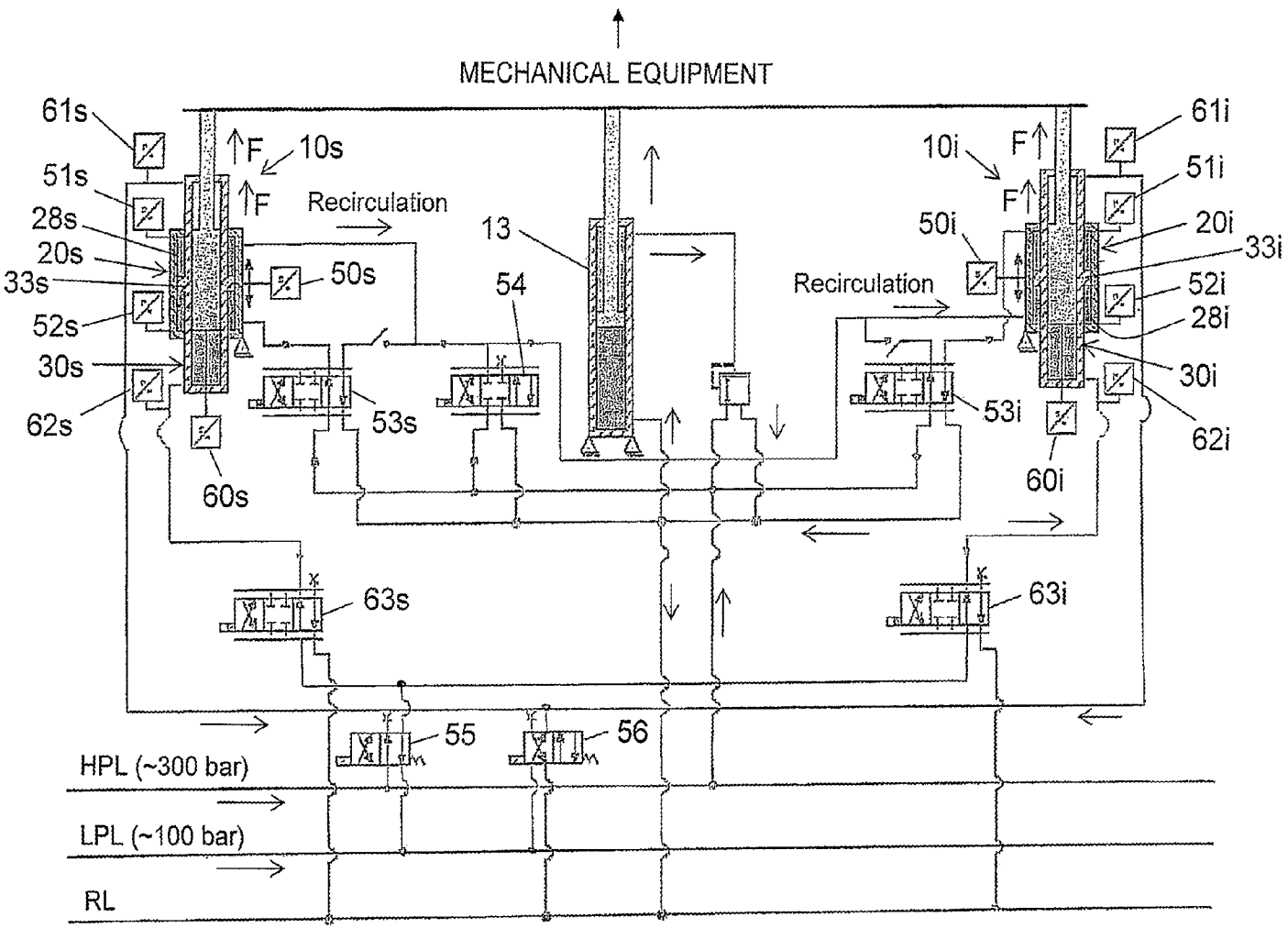
Figure 9:
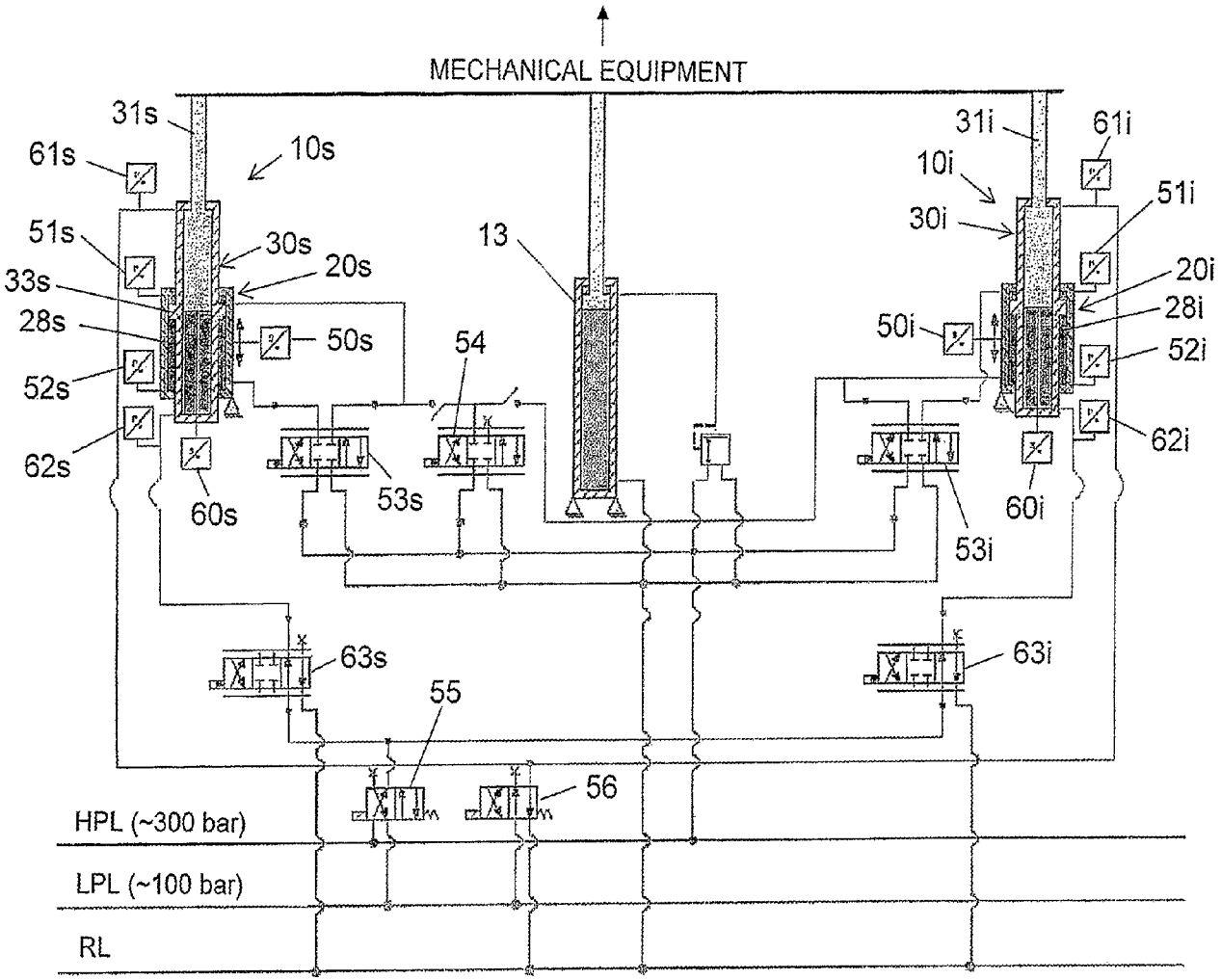
Figure 10:
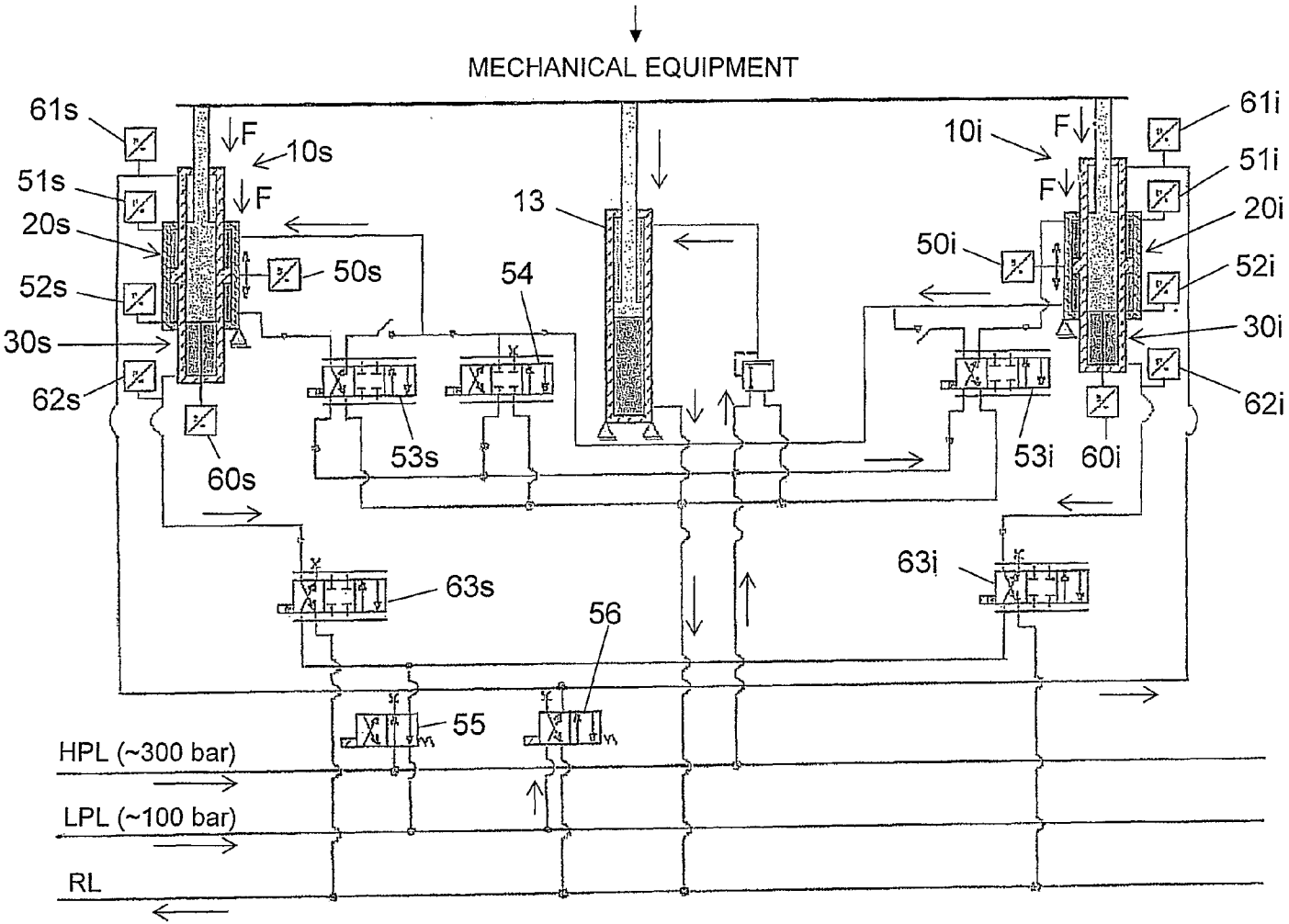
Figure 11:
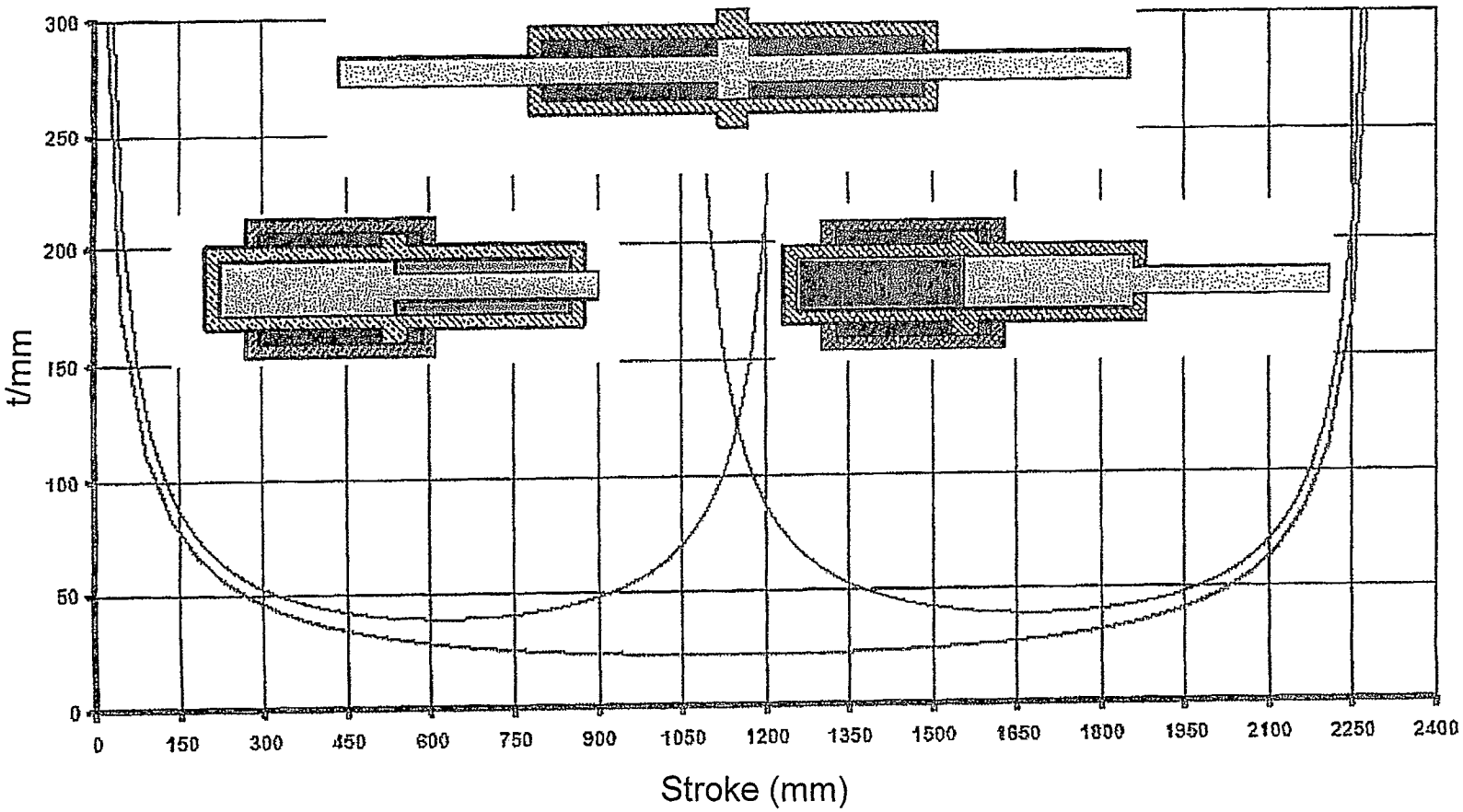

FIG. 4*a* is a partial view of the adjustment device of FIGS. 2 and 3 with the cylinder groups in rest condition;

FIG. 4*b* is a view similar to that of FIG. 4*a* with the external cylinders in maximum extension position and the internal cylinders in "all in" (OFF) position;

FIG. 5*a* is a view similar to that of FIG. 2*a* with the external cylinders in rest position and the internal cylinders in "all out" (ON) position;

FIG. 5*b* is a view similar to that of FIG. 2*a* with internal cylinders in "all out" position and the external cylinders in maximum extension position;

FIG. 6 shows the connection between the stroke and the movement speed of the cylinder group;

FIG. 7 shows the connection between the stroke and the movement time of the cylinder groups;

FIG. 8 is a hydraulic oil scheme, which illustrates the functioning of the adjustment device in the step of bringing the rollers closer to the work position;

FIG. 9 is a hydraulic oil scheme, which illustrates the functioning of the adjustment device in edging step, with the rollers in a possible work position;

FIG. 10 is a hydraulic oil scheme, which illustrates the functioning of the adjustment device in the step of moving the rollers away from the work position; and FIG. 11 graphically illustrates the comparison, given the same stroke carried out, between the stiffness of a single-cylinder adjustment system and a cylinder group adjustment system according to the invention.

In the drawing set, equivalent or similar parts or and components were identified with the same reference numbers.

DETAILED DESCRIPTION OF THE INVENTION

With reference to FIGS. 1A-1C, the adjustment device according to the invention comprises actuator means with completely hydraulic actuation, in particular a cylinder group 10 composed of an external cylinder 20 and an internal cylinder 30.

The external cylinder 20 is formed of a front flange 22, a rear flange 24 and a liner 26, which delimits, a first cylindrical chamber 28, sealed closed by the front and rear flanges 22, 24. The external cylinder also includes a hollow tubular stem 21, which bears a piston 23, sealingly slidable in the first cylindrical chamber 28 and adjustable so as to be able to assume a plurality of positions that can vary between a completely withdrawn position (FIG. 1A) and a completely advanced position (FIG. 1B), carrying out an overall stroke $C_E$. For its functioning mode, the external cylinder 20 will be indicated below with the expression 'cylinder with controlled stroke piston' or 'controlled cylinder.

The hollow stem 21 of the controlled cylinder 20 acts as a liner 36 of the internal cylinder 30, such liner 36 delimiting a second cylindrical chamber 38. The internal cylinder 30 can thus slide through the front flange 22 of the controlled cylinder 20 and also comprises a front flange 32, that seals the second cylindrical chamber 38. The internal cylinder 30 also comprises a tubular stem 31, which bears a piston 33. The piston 33 sealingly slides in the second cylindrical chamber 38 and can assume only two positions, i.e. a completely withdrawn or "all in" position (FIGS. 1A and 1B) and a completely advanced or "all out" position (FIG. 1C), carrying out a fixed stroke $C_I$. For its functioning mode, the internal cylinder 30 will be indicated below with the expression 'cylinder with piston all in/all out' or 'ON/OFF or fixed stroke cylinder'.

The controlled cylinder 20 and the ON/OFF cylinder can be separately moved, by carrying out the respective strokes $C_E$ and $C_I$, or they are moved together, so to cover a range of strokes from 0 to a value equal to the sum $C_{TOT}$ of the strokes $C_E$ and $C_I$. To this end, the controlled cylinder 20 advantageously has a stroke $C_E$ that is greater than the stroke $C_I$ of the ON/OFF cylinder 30.

According to one particularly advantageous embodiment of the invention, illustrated in FIGS. 2 and 3, an adjustment device of the invention comprises a pair of cylinder groups, respectively an upper. cylinder group 10*s* and a lower cylinder group 10*i*.

Each cylinder group 10*s*, 10*i* is associated with respective mechanical equipments 11*s*, 11*i* for driving a roller 40 of an edger of a rolling mill and comprises an external or controlled cylinder 20*s*, 20*i* and an internal or ON/OFF cylinder 30*s*, 30*i* slidable in the external cylinder. The controlled cylinders 20*s*, 20*i* and the ON/OFF cylinders 30*s*, 30*i* have the same configuration as the cylinders 20, 30 described with reference to the FIGS. 1A-1C.

In order to maintain a correct contact between the mechanical equipments 11*s*, 11*i* and the upper and lower cylinder groups 10*s*, 10*i*, balancing means are provided, for example a balancing cylinder 13, appropriately adjusted, whose functioning is known to those skilled in the art, so that it will not be described in the present document.

In FIGS. 4*a*-5*b*, different operating conditions are illustrated of a pair of cylinder groups 10*s*. It is understood that an analogous discussion holds for the cylinder group pair 10*i*.

Specifically, in the rest condition, illustrated in FIG. 4*a*, the controlled cylinders 20*s* as well as the ON/OFF cylinders 30*s* have respective stems 21*s* and 31*s* in totally withdrawn position. In the operative condition illustrated in FIG. 4*b*, the stems 31*s* of the ON/OFF cylinders 30*s* are in "all in" position (OFF), while the stems 21*s* of the controlled cylinders 20*s* are in maximum extension position, equal to a stroke $C_E$~1150 mm. In the operating position of FIG. 5*a*, the stems 21*s* of the controlled cylinders 20*s* are in totally withdrawn position while the stems 31*s* of the ON/OFF cylinders are in "all out" (ON) position, equal to a stroke $C_I$~1050 mm. Finally, in the operative condition of FIG. 5*b*, the stems 31*s* of the ON/OFF cylinders are still in "all out position" (ON), while the stems 21*s* of the control cylinders 20*s* are in totally extended position, equal to a stroke $C_{TOT}=C_E+C_I=2200$ mm.

Due to the single or combined movement of the controlled and ON/OFF cylinders, the cylinder groups can cover a variable stroke range, for example from about 1000 mm to about 2500 mm, so to permit working slabs B of width L variable from about 4800 mm to about 1100 mm.

The double cylinder group has, with respect to single cylinder systems, advantages in terms of increase of the speed and consequent reduction of the times of cylinder positioning, and thus adjustment of the distance between the rollers 40. This is clearly illustrated in the diagrams represented in FIGS. 6 and 7, which show the connection between the strokes $C_E$ and $C_I$, of controlled cylinder 20, 20*s*, 20*i* and ON/OFF cylinder 30, 30*s*, 30*i*, respectively, and the speed and time of positioning of the cylinder group 10, 10*s*, 10*i*. It is assumed that, as exemplifying and non-limiting, the controlled cylinder 20, 20*s*, 20*i* completes a stroke $C_E=1150$ mm at a speed $V_E=60$ mm/sec and that the ON/OFF cylinder 30, 30*s*, 30*i* completes a stroke $C_I=1050$ mm at a speed $V_I=100$ mm/sec.

For strokes up to $C_I=1050$ mm, only the controlled cylinder 20, 20*s*, 20*i* is actuated, which is moved at the speed $V_E=60$ mm/sec (section (1), FIG. 6) for a time $t_E=17.5$ sec (section (1), FIG. 7). For a stroke equal to CI, only the ON/OFF cylinder 30, 30*s*, 30*i* is actuated, which is brought into "all out" position, completing the entire stroke CI at the speed $V_I=100$ mm/sec (section (2), FIG. 6) in a time $t_I=10.5$ sec (section (2), FIG. 7). For strokes greater than $C_I$, the controlled cylinders 20, 20*s*, 20*i* and ON/OFF cylinders 30, 30*s*, 30*i* both move until the ON/OFF 30, 30*s*, 30*i* cylinder reaches its "all out" position in the time $t_I$=10.5 sec (section (3), FIG. 7); the speed of the cylinder group 10, 10*s*, 10*i* increases until it reaches a value $V_{TOT}=V_E+V_I$=160 mm/sec (section (3), FIG. 6). Once the time $t_I$ has passed, the ON/OFF cylinder 30, 30*s*, 30*i* has carried out its entire stroke $C_I$, so that only the controlled cylinder 20, 20*s*, 20*i* is activated, which is moved at the speed $V_E$=60 mm/sec; the speed of the cylinder group 10, 10*s*, 101 decreases (section (4), FIG. 6) and its positioning time increases (section (4), FIG. 7).

With reference now to the hydraulic oil schemes illustrated in FIGS. 8-10, the functioning of the adjustment device of the invention with double upper 10*s* and lower 10*i* cylinder group, of FIGS. 2 and 3 will be described in detail. For the ease of exposition, reference will be made to only one pair of cylinder groups, for example that on the motor-side, but it should be understood that the same discussion holds true for the cylinder group pair on the operator-side.

In particular, two main steps are provided for: a vacuum positioning step, i.e. in absence of material, of the cylinder groups 10*s*, 10*i*, schematically illustrated in FIGS. 8 and 10, and a working or edging step of a bar or sheet, schematically illustrated in FIG. 9.

During the vacuum positioning step, the controlled cylinders 20*s*, 20*i* and ON/OFF cylinders 30*s*, 30*i* are moved, separately or together, so to cause the rollers 40 to move closer to (FIG. 8) or away from (FIG. 10) the work position inside the edger.

With particular reference to FIG. 8, in which the vacuum positioning step is illustrated for bringing the rollers 40 closers, the controlled cylinders 20*s*, 20*i* and the ON/OFF cylinders 30, 30*a* are moved together. Specifically, the controlled cylinders 20*s*, 20*i* are supplied, through a high pressure line HPL, typically at 300 bars, by supply means of known type, for example a high pressure piston pump group (not shown in the drawings). The respective pistons 33*s*, 33*i* therefore carry out an outgoing stroke (F arrows, FIG. 8) into the respective cylindrical chambers 28*s*, 28*i*. Each stroke is controlled by a position transducer 50*s*, 50*i*, by a pair of pressure transducers 51*s*, 51*i* and 52*s*, 52*i* and by a servo-valve 53*s*, 53*i*, all controlled by an electronic control unit CU (not shown).

In the case of long strokes, a recirculation circuit is advantageously provided, adapted to conduct the outlet flow rate from the cylindrical chamber of one of the external cylinders, for example the cylinder 20*s*, to the inside of the cylindrical chamber of the opposite cylinder 20*i*. This permits reducing the necessary flow rate of the high pressure pump in this step.

In addition, in order to avoid a possible misalignment of the controlled cylinders 20*s*, 20*i*, typically caused by hydraulic oil leaks from the respective cylindrical chambers 28, 28*a*, an additional servo-valve 54 is used, also controlled by the control unit CU.

More in particular, the CU executes a comparison between the positions of the cylinders and adds or subtracts flow rate to the overall flow rate exchanged between them, depending on the lower or greater speed of one of the cylinders, said slave cylinder, with respect to the other, said master cylinder.

The ON/OFF cylinders 30*s*, 30*i* complete their entire stroke $C_I$ supplied, through a low pressure line LPL, typically on the order of 100 bar, by supply means of known type, for example screw pump groups with large flow rate but reduced pressure (not shown in the drawings) controlled by the electronic control unit CU. These too, like the external cylinders 20*s*, 20*i*, are provided with a position transducer 60*s*, 60*i*, a pair of pressure transducers 61*s*, 61*i* and 62*s*, 62*i* and a servo-valve 63*s*, 63*i*, all controlled by the CU.

The alignment between the two internal cylinders 30*s*, 30*i* and the synchronisation of their movement is achieved by means of a control loop using the servo-valves 63*s*, 63*i* and the position sensors 60*s*, 60*i*.

When the ON/OFF cylinders 30*s*, 30*i* reach the "all out" (ON) position illustrated in FIG. 9, the chambers 38*s*, 38*i* on the side of the piston are pressurised, connecting them to the high pressure supply line by actuating a two-way valve 55 and the stem side chamber is connected with the discharge line RL by actuating a further two-way valve 56. This permits obtaining a locking force of the stems 31*s*, 31*i* that is greater than the maximum force resulting from the work load. Therefore, in the working step, the ON/OFF cylinders 30*s*, 30*i* behave like rigid spacers.

Since, during the working step, the controlled cylinders and ON/OFF cylinders 20*s*, 20*i* and 30*s*, 30*i* are all supplied from the high pressure line HPL, the low pressure line, with the related screw pump group supplies a hydraulic oil conditioning circuit, whose function is to maintain the temperature of the oil over values not exceeding 70-80° C. It is known, in fact, that in a hydraulic circuit there is a generation of heat, with consequent increase of the temperature and alteration of the chemical-physical characteristics of the hydraulic oil.

The movement step for moving the rollers 40 away, illustrated in FIG. 10, is entirely analogous to that for bringing them together illustrated in FIG. 8, with the difference that the controlled cylinders 20*s*, 20*i* and the ON/OFF cylinders 30, 30*a* are moved, together or separately, by carrying out a stroke that is reverse that completed in the moving closer step (F arrows, FIG. 10).

In addition to the advantages in terms of speed and movement time, the double cylinder group of the invention has, with respect to a single cylinder system, advantages also in terms of stiffness. This is schematically shown in the graph of FIG. 11. Such graph shows a comparison between the stiffness of a double cylinder system, external or controlled and internal or ON/OFF, according to the invention (upper lines) and that of a single cylinder system with stroke equal to the sum of the strokes of the controlled cylinders and ON/OFF cylinders (lower line).

As can be observed, in the case of a single cylinder, the stiffness reaches its minimum value at half the stroke (~1200 mm), while the double cylinder system permits maintaining the stiffness of the controlled cylinders 20, 20*s*, 20*i*, extending their action stroke by means of the ON/OFF cylinders 30, 30*s*, 30*i*, which, as said above, in extreme conditions behave like non-deformable spacers.

Due to its increased stiffness characteristics, the system according to the invention has a higher frequency and consequently reduced response times while the increase of speed involves performance improvement.

Although the invention was described by referring to a preferred embodiment thereof, those skilled in the art will understand that numerous modifications and variations can be made thereto, which fall within the scope defined by the accompanying claims. For example, even if in the described embodiments the external cylinder was taken as controlled cylinder and the internal cylinder as ON/OFF cylinder, the same discussion holds even if the controlled cylinder is taken as the internal cylinder and the ON/OFF cylinder as the external cylinder.

The invention claimed is:

1. An edger of a rolling mill, comprising at least a pair of work rollers and a device for adjusting the distance between said pair of work rollers, said device comprising actuator means associated with a respective work roller wherein said actuator means comprises a first cylinder group including at least two cylinders associated with each other so to slide inside each other and movable between a maximum distance position between the rollers and a minimum distance position between the rollers, wherein said at least two cylinders comprise a controlled stroke cylinder and a fixed stroke cylinder, wherein the fixed stroke cylinder is arranged to slide only between a fully withdrawn position and a fully extended position with respect to the fixed stroke cylinder, and wherein the controlled stroke cylinder is arranged to slide between any position between a fully withdrawn position and a fully advanced position with respect to the controlled stroke cylinder.

2. The edger according to claim 1, wherein the controlled stroke cylinder comprises a front flange, a rear flange, a first liner, a first stem, and a first piston, wherein the first liner delimits a first cylindrical chamber, the first stem and a first piston movable in the first cylindrical chamber so as to complete a first stroke.

3. The edger according to claim 2, wherein the fixed stroke cylinder comprises a second stem, a second piston, and a second liner, wherein the second liner which delimits a second cylindrical chamber, the second stem and the second piston movable in the second cylindrical chamber so as to complete a second stroke.

4. The edger according to claim 3, wherein the first stem of the controlled stroke cylinder acts as the second liner for fixed stroke cylinder.

5. The edger according to claim 3, wherein the first stroke of the controlled stroke cylinder is greater than the second stroke of the fixed stroke cylinder.

6. The edger according to claim 1, further comprising a second cylinder group including a second controlled stroke cylinder and a second fixed stroke cylinder, the second cylinder group associated with the respective roller.

7. The edger according to claim 6, wherein said further second cylinder group is moved in a synchronous manner with respect to said first cylinder group.

8. The edger according to claim 1, further comprising position detector means associated with each cylinder of said first cylinder group.

9. The edger according to claim 1, further comprising pressure detector means associated with each cylinder of said first cylinder group.

10. The edger according claim 6, wherein a balancing means is used between said first cylinder group and said second cylinder group.

11. The edger according to claim 1, wherein the controlled stroke cylinder is connected to a lower pressure line and said fixed stroke cylinder is connected to a high pressure line.

12. A method for adjusting the distance of a pair of rollers to an edger, wherein a device for adjusting the distance between said pair of rollers comprises an actuator means associated with a respective roller of said pair of rollers, wherein said actuator means comprises a cylinder group including at least two cylinders associated with each other so as to slide inside each other and move between a maximum distance position between the rollers and a minimum distance position between the rollers, wherein the at least two cylinders comprise a controlled stroke cylinder and a fixed stroke cylinder, wherein the fixed stroke cylinder is arranged to slide only between a fully withdrawn position and a fully extended position with respect to the fixed stroke cylinder, and wherein the controlled stroke cylinder is arranged to slide between any position between a fully withdrawn position and a fully advanced position with respect to the controlled stroke cylinder, and wherein the method comprises: bringing closer together the cylinder groups of said pair of rollers starting from a rest position; working or edging a bar or sheet between the rollers; and returning the cylinder groups to the rest position.

13. The process according to claim 12, wherein bringing closer together the cylinder groups comprises: activating one or both of the controlled stroke and fixed stroke cylinders associated with each cylinder group; and locking in "all out" position of the fixed stroke cylinder associated with each cylinder group.

14. A method for adjusting a distance between two rollers, comprising: providing at least one actuator to move one of the rollers, wherein the actuator comprises: a controlled stroke hydraulic cylinder comprising a first cylindrical chamber and a first piston, wherein the first piston is sealingly slidable in the first cylindrical chamber and adjustable to any position between a first fully withdrawn position and a first fully extended position, and further wherein the first piston is coupled to a hollow stem; and a fixed stroke hydraulic cylinder comprising a second cylindrical chamber and a second piston, wherein the hollow stem is a liner for the second cylindrical chamber, and the second piston is sealingly slidable in the second cylindrical chamber and adjustable only to a second fully withdrawn position or a second fully extended position; wherein when the first piston is adjusted to the first fully extended position or the second piston is adjusted to the second fully extended position, the distance, between the rollers, decreases; adjusting a first position of the first piston of the controlled stroke cylinder and a second position of the second piston of the fixed stroke cylinder to move the roller from a rest position to a working position.

15. The method of claim 14, further comprising: returning the roller to the rest position by adjusting positions of the first piston and the second piston.

16. The method of claim 14, wherein the first piston and the second piston are adjusted simultaneously.

17. An apparatus for adjusting a distance between two rollers, comprising: at least one actuator to move one of the rollers, wherein the actuator comprises: a controlled stroke hydraulic cylinder comprising a first cylindrical chamber and a first piston, wherein the first piston is sealingly slidable in the first cylindrical chamber and adjustable to any position between a first fully withdrawn position and a first fully extended position, and further wherein the first piston is coupled to a hollow stem; and a fixed stroke hydraulic cylinder comprising a second cylindrical chamber and a second piston, wherein the hollow stem is a liner for the second cylindrical chamber, and the second piston is sealingly slidable in the second cylindrical chamber and adjustable only to a second fully withdrawn position or a second fully extended position; wherein when the first piston is adjusted to the first fully extended position or the second piston is adjusted to the second fully extended position, the distance between the rollers decreases.

18. The apparatus of claim 17, wherein a first stroke of the first piston that moves the controlled stroke hydraulic cylinder to the first fully extended position is larger than a second stroke of the second piston that moves the fixed stroke hydraulic cylinder to the second fully extended position.

19. The apparatus of claim 17, wherein a first speed of the first piston is slower than a second speed of the second piston.

20. The apparatus of claim 17, wherein a first pressure line is used to move the first piston, and a second pressure line having a lower pressure than the first pressure line is used to move the second piston.

21. The apparatus of claim 17, wherein a set of two actuators is used for moving each of the two rollers.

22. The apparatus of claim 21, wherein a balancing means is used between the two actuators used to move each of the rollers, wherein the balancing means corrects contact between the two actuators.

23. The edger of claim 1, wherein the actuator means is adapted to sum strokes of the at least two cylinders associated with each work roller while maintaining, at the same time, a stiffness of the edger.

* * * * *